United States Patent [19]

Ferrero

[11] Patent Number: 4,500,121

[45] Date of Patent: Feb. 19, 1985

[54] DEVICE FOR STOPPING AND HOLDING IN THE OPEN POSITION A SLIDING DOOR ON A VEHICLE

[75] Inventor: Giuseppe Ferrero, Cherasco, Italy

[73] Assignee: Fiat Auto S.p.A., Turin, Italy

[21] Appl. No.: 514,125

[22] Filed: Jul. 15, 1983

[30] Foreign Application Priority Data

Jul. 15, 1983 [IT] Italy ..... 53517/82[U]

[51] Int. Cl.[3] ..... E05C 19/04

[52] U.S. Cl. ..... 292/79; 292/DIG. 46

[58] Field of Search ..... 292/78, 79, DIG. 46, 292/DIG. 4, DIG. 19, DIG. 72, 216, 213

[56] References Cited

U.S. PATENT DOCUMENTS 845,344 2/1907 Gallinger ..... 292/79
1,515,704 11/1924 Sherman et al. ..... 292/79
1,564,104 12/1925 Olson ..... 292/79 X
1,642,203 9/1927 Hilfinger ..... 292/DIG. 19
2,513,069 6/1950 Weissinger ..... 292/DIG. 19

*Primary Examiner*—Richard E. Moore
*Attorney, Agent, or Firm*—Sughrue, Mion, Zinn, Macpeak, and Seas

[57] ABSTRACT

A device for stopping and holding a sliding door on a vehicle in the open position includes a sheet metal support fixed to the door, a V-shaped lever pivoted on the support and a guide rail having a spaced apart triangular projection and end stop for cooperation with a pivoted lever. The distance between the triangular projection and the end stop is such that in the last portion of the opening strip of the door one of the slopes of the projection causes the lever to rotate against the action of a spring and that in the open position of the door the free end of an arm of the lever will abut against the end stop and the roller carried by the other end of the lever will abut against a side of the triangular projection which is inclined toward the end stop.

1 Claim, 2 Drawing Figures

DEVICE FOR STOPPING AND HOLDING IN THE OPEN POSITION A SLIDING DOOR ON A VEHICLE

Figure 1:
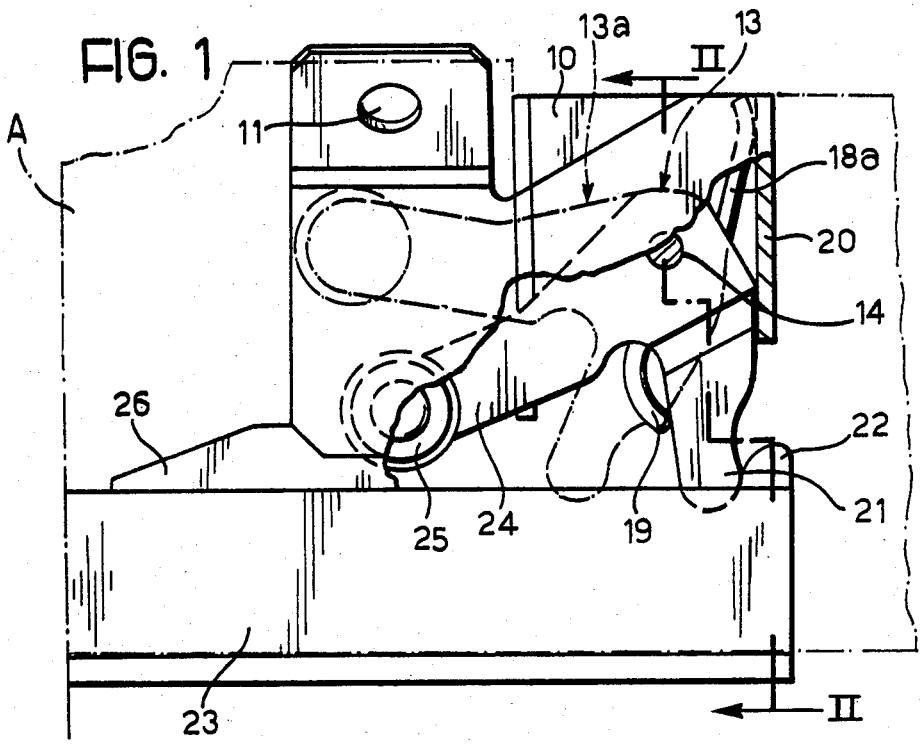

This invention relates to a device for stopping and holding in the open position a sliding door on a vehicle.

The object of the invention is to provide a device of the above mentioned type which is simple and easy to manufacture and which takes up little room.

In view of accomplishing said object and further objects which shall be pointed out by the following description, this invention concerns a device for stopping and holding in the open position a sliding door on a vehicle comprising:

a sheet metal support 10 fixed to the door, a V-shaped lever 13, pivoted at the vertex of the V on a pin 14 carried by said support and having a first and a second arm, a roller 25 rotatably mounted at the free end of said first arm of the lever, a guide rail 23, a spring 18 interposed between said lever and said support, said spring causing said lever to rotate on said pin in order to press said roller on said rail, a projection 26 carried by said guide rail, said projection having a substantially triangular profile with two slopes inclined in opposite directions, an end stop 22 carried by said rail, said end stop 22 cooperating with said second arm of said V-shaped lever, the distance between said triangular projection 26 and said end stop 22 being such that in the last portion of the opening stroke of the door one of the slopes of said projection causes said lever 13 to rotate on said pin 14 against the action of said spring 18 and that in the open position of the door the free end of said second arm of the lever 13 abuts against said stop 22 and the roller 25 carried by the free end of said first arm abuts against the other slope of said triangular projection 26 which is inclined towards said end stop 22.

Further features and advantages shall be pointed out in the following description, referred to the annexed drawings which are submitted by way of example only.

Figure 2:
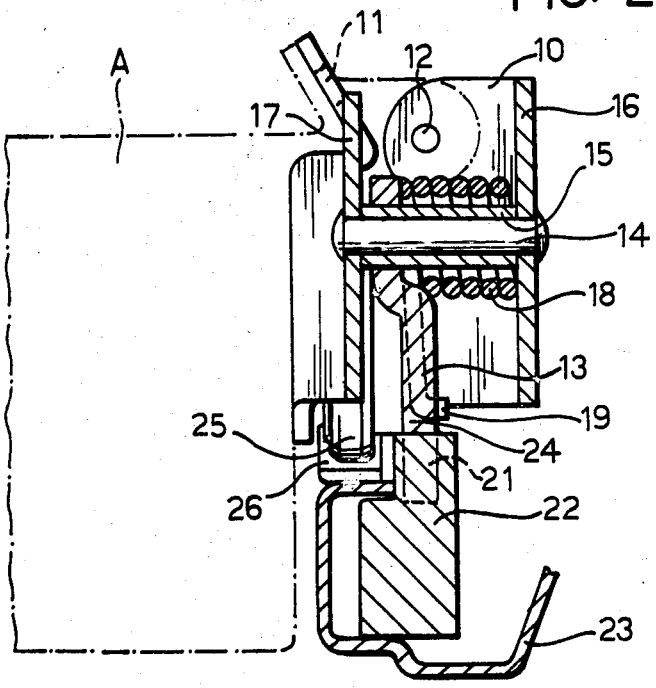

In the drawings:

FIG. 1 is a plan view, partly in cross-section, of a device according to this invention shown in the open position of the door, FIG. 2 is a cross-sectional view on line II—II of FIG. 1.

In the drawings, 10 is a sheet-metal support, which is shaped in order to form a rectangular cavity and is provided with holes 11, 12 for the connection to a sliding door A of a motor vehicle.

A V-shaped lever 13 is pivoted at the vertex of the V in the cavity of support 10 on a bushing 15. Bushing 15 is carried by a pin 14 which is fixed to two sides 16, 17 of the support 10.

A wire spring 18 is coiled around bushing 15; an arm 18*a* of spring 18 abuts against a side 20 of support 10 and an arm 19 abuts against lever 13 and causes said lever to rotate in an anti-clockwise direction.

The free end 21 of one of the arms of lever 13 is of rounded shape and abuts in the open position of the door against a stop 22 carried by a guide rail 23 which is fixed to the vehicle body.

The free end 24 of the other arm of lever 13 carries a freely-rotatable roller 25 which is pressed by the action of spring 18 against the guide rail 23.

Rail 23 is provided with a substantially triangular projection 26.

The above described device operates as follows. When the leading edge of door A approaches the end of the opening stroke, roller 25 is compelled to pass over the projection 26 causing rotation of lever 13 against the action of spring 18, the arm 19 of which abuts against said lever. When the rounded free end 21 of lever 13 abuts against stop 22 the residual momentum of the door causes a clock-wise rotation of lever 13 to the position shown in dash and dot lines at 13*a* in FIG. 1, thus increasing the load of spring 18.

Lever 13 returns subsequently to the position shown in full lines in FIG. 1, in which the door is held in its open position by the action of lever 13 against stop 22 and projection 26. In order to close the door it is necesesary to overcome the action of spring 18 for allowing roller 25 to pass over projection 26; an accidental closure of the door is thus prevented.

I claim:

1. A device for stopping and holding in the open position a sliding door on a vehicle comprising:

a sheet metal support fixed to the door, a V-shaped lever, pivoted at the vertex of the V on a pin carried by said support and having a first and a second arm, a roller rotatably mounted at the free end of said first arm of the lever, a guide rail, a spring interposed between said lever and said support, said spring causing said lever to rotate on said pin in order to press said roller on said rail, a projection carried by said guide rail, said projection having a substantially triangular profile with two slopes inclined in opposite directions, an end stop carried by said rail, said end stop cooperating with said second arm of said V-shaped lever, the distance between said triangular projection and said end stop being such that in the last portion of the opening stroke of the door one of the slopes of said projection causes said lever to rotate on said pin against the action of said spring and that in the open position of the door the free end of said second area of the lever abuts against said stop and the roller carried by the free end of said first arm abuts against the other slope of said triangular projection which is inclined towards said end stop.

* * * * *